US009229381B2

(12) United States Patent
Saitoh

(10) Patent No.: US 9,229,381 B2
(45) Date of Patent: Jan. 5, 2016

(54) CLEANING DEVICE, FIXING DEVICE INCLUDING THE CLEANING DEVICE, AND IMAGE FORMING APPARATUS INCLUDING THE FIXING DEVICE

(71) Applicant: Seiji Saitoh, Kanagawa (JP)

(72) Inventor: Seiji Saitoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/513,350

(22) Filed: Oct. 14, 2014

(65) Prior Publication Data

US 2015/0125190 A1 May 7, 2015

(30) Foreign Application Priority Data

Nov. 6, 2013 (JP) ..... 2013-230322

(51) Int. Cl.
*G03G 15/20* (2006.01)

(52) U.S. Cl.
CPC ..... *G03G 15/2025* (2013.01)

(58) Field of Classification Search
CPC ..... G03G 15/2025; G03G 15/2075; G03G 21/0041
See application file for complete search history.

(56) References Cited

U.S. PATENT DOCUMENTS

| | | | | |
|---|---|---|---|---|
| 6,679,601 | B1 * | 1/2004 | Pham et al. | 347/104 |
| 2009/0123200 | A1 * | 5/2009 | Achten et al. | 399/327 |
| 2011/0176851 | A1 | 7/2011 | Kuwana et al. | |

FOREIGN PATENT DOCUMENTS

| | | | |
|---|---|---|---|
| JP | 59-109082 | | 6/1984 |
| JP | 63-050878 | | 3/1988 |
| JP | 1195600 | | 4/1999 |
| JP | 2002-244474 | | 8/2002 |
| JP | 2004037556 | A | 2/2004 |
| JP | 2004-333683 | | 11/2004 |
| JP | 2008-015444 | | 1/2008 |
| JP | 2008051887 | A | 3/2008 |
| JP | 2011-170324 | | 9/2011 |
| JP | 2012-082025 | | 4/2012 |
| JP | 2013-120282 | | 6/2013 |
| JP | 2013-225123 | | 10/2013 |

OTHER PUBLICATIONS

Machine translation of JP 2008-051887 A.*
Machine translation of JP 2004-037556.*

* cited by examiner

*Primary Examiner* — G. M. Hyder
(74) *Attorney, Agent, or Firm* — Harness, Dickey & Pierce, P.L.C.

(57) ABSTRACT

A cleaning device includes a web sheet, a holding member, a reel member, a drive device, a pressing member, and a rotational load-applying device. The web sheet slides against and cleans a surface of a cleaning target object. The holding member holds the web sheet wound around the holding member to be reeled out. The reel member has the web sheet wound around the reel member to be reeled in. The drive device drives the reel member to rotate. The pressing member presses the web sheet against the cleaning target object. The rotational load-applying device applies a load to rotation of the holding member. The load is changeable depending on an amount of the web sheet held by the holding member.

14 Claims, 14 Drawing Sheets

CLEANING DEVICE, FIXING DEVICE INCLUDING THE CLEANING DEVICE, AND IMAGE FORMING APPARATUS INCLUDING THE FIXING DEVICE

CROSS-REFERENCE TO RELATED APPLICATION

This patent application is based on and claims priority pursuant to 35 U.S.C. §119(a) to Japanese Patent Application No. 2013-230322, filed on Nov. 6, 2013, in the Japan Patent Office, the entire disclosure of which is hereby incorporated by reference herein.

BACKGROUND

1. Technical Field

This disclosure relates to a cleaning device including a web sheet that slides against and cleans a surface of a cleaning target object, a fixing device including the cleaning device, and an image forming apparatus, such as a copier, a facsimile machine, or a printer, including the fixing device.

2. Related Art

An image forming apparatus, such as a copier, a facsimile machine, or a printer, includes a fixing device that fixes unfixed toner of a toner image formed on a sheet serving as a recording medium. The fixing device applies heat and pressure to the unfixed toner on the sheet in a fixing nip, in which a fixing member such as a fixing belt or a fixing roller and a pressing member such as a pressure roller are pressed against each other, to thereby fuse and fix the toner image on the sheet.

The toner fused in and passing through the fixing nip may not all be fixed on the sheet, and may instead partially adhere to the fixing member. The toner adhering to the moving fixing member may contaminate a surface of a sheet separation pawl, a fixing member surface temperature sensor, or the pressing member in contact with the fixing member, and adhere to the next fed sheet. To address this issue, a cleaning device employing a web cleaning system using a web sheet as a cleaning member may be used.

SUMMARY

In one embodiment of this disclosure, there is provided an improved cleaning device that, in one example, includes a web sheet, a holding member, a reel member, a drive device, a pressing member, and a rotational load-applying device. The web sheet slides against and cleans a surface of a cleaning target object. The holding member holds the web sheet wound around the holding member to be reeled out. The reel member has the web sheet wound around the reel member to be reeled in. The drive device drives the reel member to rotate. The pressing member presses the web sheet against the cleaning target object. The rotational load-applying device applies a load to rotation of the holding member. The load is changeable depending on an amount of the web sheet held by the holding member.

In one embodiment of this disclosure, there is provided an improved fixing device that, in one example, includes a fixing member, a pressing member, and the above-described cleaning device. The fixing member has an endless movable surface and houses a heating device. The pressing member has an endless movable surface that comes into contact with the fixing member to form a fixing nip between the pressing member and the fixing member. The cleaning device cleans the surface of at least one of the fixing member and the pressing member. A recording medium carrying a toner image is fed through the fixing nip to fix the toner image on the recording medium with heat and pressure.

In one embodiment of this disclosure, there is provided an improved image forming apparatus that, in one example, includes an image carrier, a toner image forming device, a transfer device, and the above-described fixing device. The toner image forming device forms a toner image on the image carrier. The transfer device transfers the toner image from the image carrier onto a recording medium. The fixing device fixes the transferred toner image on the recording medium.

BRIEF DESCRIPTION OF THE DRAWINGS

A more complete appreciation of this disclosure and many of the advantages thereof are obtained as the same becomes better understood by reference to the following detailed description when considered in connection with the accompanying drawings, wherein.

DETAILED DESCRIPTION

Figure 1:
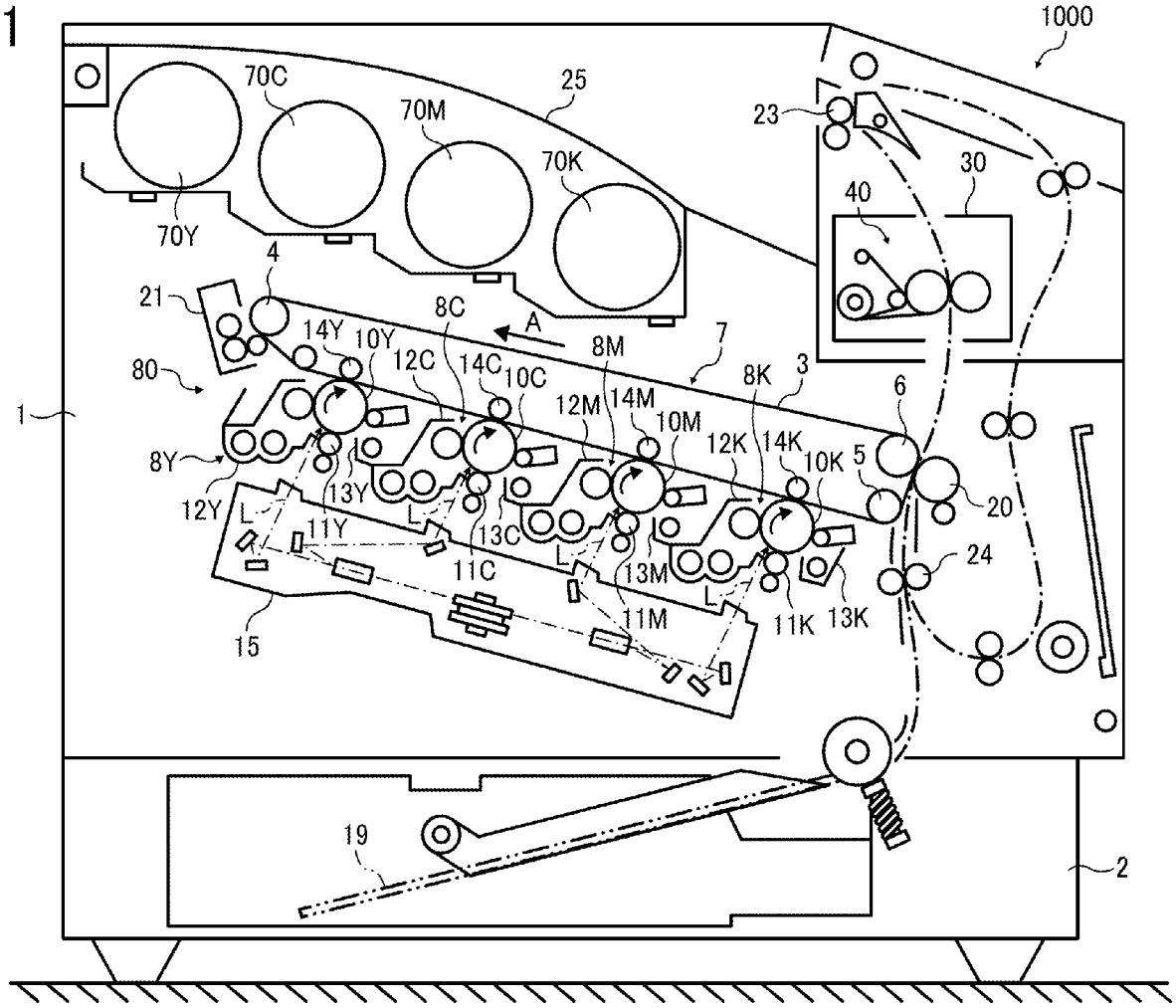
FIG. 1 is a schematic diagram illustrating a configuration of a printer according to an embodiment of this disclosure.

In describing the embodiments illustrated in the drawings, specific terminology is adopted for clarity. However, this disclosure is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, an electrophotographic image forming apparatus according to an embodiment of this disclosure will be described.

The image forming apparatus according to the present embodiment is an electrophotographic tandem color printer (hereinafter simply referred to as the printer) 1000 capable of forming a full-color image. The image forming apparatus according to the present embodiment, however, is not limited to the color image forming apparatus, and may be a monochrome image forming apparatus. Further, the image forming apparatus according to the present embodiment is not limited to the printer, and may be a copier or a facsimile machine, for example.

FIG. 1 is a schematic diagram illustrating a configuration of the printer 1000 according to the present embodiment. The printer 1000 includes a main unit 1, a sheet feed cassette 2 disposed under the main unit 1 to store transfer sheets 19 serving as recording media, and a control unit that controls the operations of devices provided in the printer 1000.

In a central part of the main unit 1 of the printer 1000, an image forming device 80 is provided that includes four image forming units 8Y, 8C, 8M, and 8K respectively including photoconductor drums 10Y, 10C, 10M, and 10K serving as image carriers. The main unit 1 also includes an intermediate transfer unit 7, an optical writing unit 15, and a fixing device 30. The intermediate transfer unit 7 includes an endless, flexible intermediate transfer belt 3 serving as an intermediate transfer member rotatably wound around tension rollers 4, 5, and 6. The optical writing unit 15 performs optical writing on the photoconductor drums 10Y, 10C, 10M, and 10K. The fixing device 30 fixes toner images on the transfer sheets 19. The image forming units 8Y, 8C, 8M, and 8K and the intermediate transfer unit 7 are attachable to and detachable from the main unit 1.

On the outer surface of the loop formed by the intermediate transfer belt 3, a secondary transfer roller 20 forming a secondary transfer device is disposed at a position facing the tension roller 6, and a belt cleaning device 21 for cleaning the outer surface of the intermediate transfer belt 3 is disposed at a position facing the tension roller 4.

A lower side of the intermediate transfer belt 3 is disposed between the tension rollers 4 and 5. In the image forming device 80 disposed under the intermediate transfer belt 3, the image forming units 8Y, 8C, 8M, and 8K are disposed facing the lower side of the intermediate transfer belt 3.

The photoconductor drums 10Y, 10C, 10M, and 10K in the image forming units 8Y, 8C, 8M, and 8K are disposed to be in contact with the outer surface of the intermediate transfer belt 3. The photoconductor drums 10Y, 10C, 10M, and 10K are surrounded by charging devices 11Y, 11C, 11M, and 11K, development devices 12Y, 12C, 12M, and 12K, and drum cleaning devices 13Y, 13C, 13M, and 13K, respectively.

Primary transfer rollers 14Y, 14C, 14M, and 14K serving as primary transfer devices are disposed at respective positions facing the photoconductor drums 10Y, 10C, 10M, and 10K via the intermediate transfer belt 3. The primary transfer rollers 14Y, 14C, 14M, and 14K primary-transfer toner images formed on the photoconductor drums 10Y, 10C, 10M, and 10K onto the intermediate transfer belt 3.

The development devices 12Y, 12C, 12M, and 12K in the image forming units 8Y, 8C, 8M, and 8K store yellow (Y), cyan (C), magenta (M), and black (K) toners, respectively. When the toners stored in the development devices 12Y, 12C, 12M, and 12K are depleted, the development devices 12Y, 12C, 12M, and 12K are resupplied from toner replenishment bottles 70Y, 70C, 70M, and 70K disposed in an upper part of the main unit 1.

The optical writing unit 15 disposed below the image forming device 80 applies optically modulated laser beams L to respective surfaces of the photoconductor drums 10Y, 10C, 10M, and 10K to form thereon latent images corresponding to the respective colors yellow, cyan, magenta, and black.

In the main unit 1, the toner replenishment bottles 70Y, 70C, 70M, and 70K, the intermediate transfer unit 7, the image forming device 80, and the optical writing unit 15 are all inclined in the same direction. With these components thus disposed, the installation area therefor is smaller than in a configuration having the components horizontally disposed in the main unit 1.

When an image forming operation starts, the photoconductor drums 10Y, 10C, 10M, and 10K in the image forming units 8Y, 8C, 8M, and 8K are driven to rotate clockwise in FIG. 1 by respective drive devices. The charging devices 11Y, 11C, 11M, and 11K uniformly charge the respective surfaces of the photoconductor drums 10Y, 10C, 10M, and 10K to a predetermined polarity. The optical writing unit 15 applies the laser beams L to the surfaces of the photoconductor drums 10Y, 10C, 10M, and 10K charged by the charging devices 11Y, 11C, 11M, and 11K, to thereby form latent images on the surfaces of the photoconductor drums 10Y, 10C, 10M, and 10K. In this process, the optical writing unit 15 exposes the photoconductor drums 10Y, 10C, 10M, and 10K to the laser beams L based on image data of single colors yellow, cyan, magenta, and black separated out of a desired full-color image.

With the rotation of the photoconductor drums 10Y, 10C, 10M, and 10K, the latent images formed on the surfaces of the photoconductor drums 10Y, 10C, 10M, and 10K respectively face the development devices 12Y, 12C, 12M, and 12K and are rendered visible as toner images with the toners from the development devices 12Y, 12C, 12M, and 12K.

One of the tension rollers 4, 5, and 6 having the intermediate transfer belt 3 wound therearound is driven by a drive device to rotate counterclockwise in FIG. 1, to thereby rotate the intermediate transfer belt 3 counterclockwise, as indicated by arrow A. The other ones of the tension rollers 4, 5, and 6 not driven to rotate by the drive device are rotated by the rotation of the intermediate transfer belt 3.

The yellow, cyan, magenta, and black toner images formed by the image forming units 8Y, 8C, 8M, and 8K are sequentially superimposed and transferred onto the outer surface of the thus-rotating intermediate transfer belt 3 by the primary transfer rollers 14Y, 14C, 14M, and 14K, respectively. Thereby, a full-color toner image is carried on the surface of the intermediate transfer belt 3.

Residual toners adhering to the surfaces of the photoconductor drums 10Y, 10C, 10M, and 10K after the transfer of the toner images are removed from the surfaces of the photoconductor drums 10Y, 10C, 10M, and 10K by the drum cleaning devices 13Y, 13C, 13M, and 13K. The surfaces of the photoconductor drums 10Y, 10C, 10M, and 10K are then discharged by discharging devices to initialize the surface potential of the photoconductor drums 10Y, 10C, 10M, and 10K in preparation for the next image formation.

Each of the transfer sheets 19 is fed along transport path extending from the sheet feed cassette 2, and a registration roller pair 24 disposed upstream of the secondary transfer roller 20 in the sheet transport direction feeds, with appropriate feed timing, the transfer sheet 19 to an area in which the tension roller 6 and the secondary transfer roller 20 face each other.

In this process, a transfer voltage having a polarity opposite that of a toner charging polarity of the toner images on the surface of the intermediate transfer belt 3 is applied to the secondary transfer roller 20 to transfer the toner images on the surface of the intermediate transfer belt 3 onto the transfer sheet 19 at the same time. The transfer sheet 19 having the toner images transferred thereto is transported to the fixing device 30 and subjected to heat and pressure during the passage through the fixing device 30, thereby fixing the toner images onto the transfer sheet 19. The transfer sheet 19 having the toner images fixed thereon is then transported to a discharging unit 23 at the end of the transport path in an upper part of the main unit 1 and discharged onto a stack tray 25 forming an upper portion of the exterior of the main unit 1. Residual toner remaining on the surface of the intermediate transfer belt 3 after the transfer of the toner images to the transfer sheet 19 is removed from the surface of the intermediate transfer belt 3 by the belt cleaning device 21.

The foregoing description has been given of the image forming operation for forming a full-color image of four colors on the transfer sheet 19. The printer 1000 according to the present embodiment is also capable of forming a unicolor image by using one of the image forming units 8Y, 8C, 8M, and 8K in the image forming device 80 and forming an image with two or three colors. To perform monochrome printing with the printer 1000 according to the present embodiment, a latent image is formed only on the photoconductor drum 10K in the image forming unit 8K, developed by the image forming unit 8K, transferred to the transfer sheet 19, and fixed thereon by the fixing device 30.

Figure 2:
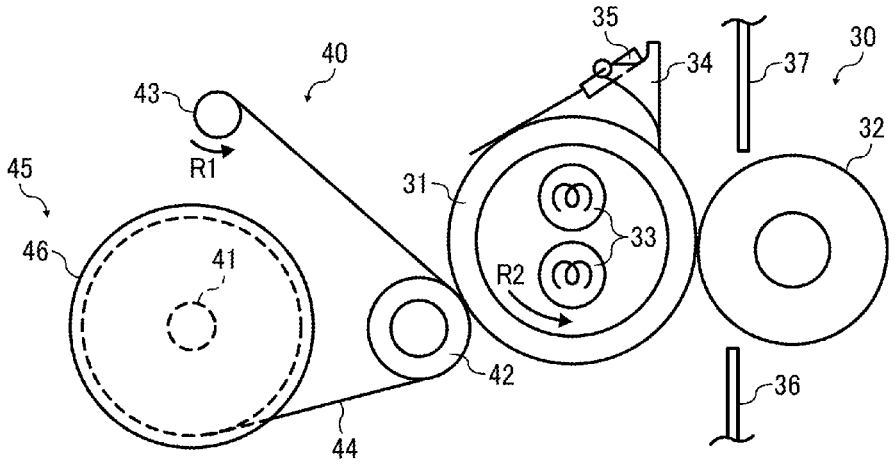
FIG. 2 is a schematic diagram illustrating a configuration of a fixing device and a cleaning device in the printer.

FIG. 2 is a schematic diagram illustrating a configuration of the fixing device 30 and a cleaning device 40 included therein. As illustrated in FIG. 2, the fixing device 30 according to the present embodiment includes a fixing roller 31 serving as a fixing member and a pressure roller 32 serving as a pressing member and pressed against the fixing roller 31 to form a fixing nip between the fixing roller 31 and the pressure roller 32.

The fixing roller 31, which houses heaters 33 serving as heating devices, is driven by a drive device to rotate counterclockwise in FIG. 2, as indicated by arrow R2. The pressure roller 32 is rotated clockwise in FIG. 2 by the rotation of the fixing roller 31. The fixing roller 31 is surrounded by a separation pawl 34 for preventing the transfer sheet 19 from winding around the fixing roller 31, a temperature sensor 35 for detecting the surface temperature of the fixing roller 31, and an entrance guide 36 and an exit guide 37 for guiding the transfer sheet 19. When the transfer sheet 19 having a toner image carried thereon is fed to the fixing nip between the fixing roller 31 and the pressure roller 32, the toner image is subjected to heat and pressure and fixed on a surface of the transfer sheet 19.

In such a fixing operation, the toner image on the transfer sheet 19 contacts with the fixing roller 31. Thus, the toner of the toner image may be transferred to a surface of the fixing roller 31. Even if various measures are taken to prevent the transfer of toner from the transfer sheet 19 to the surface of the fixing roller 31, transfer of a slight amount of toner to the fixing roller 31 is inevitable. If the amount of toner transferred to the surface of the fixing roller 31 is increased, the toner may again adhere to the surface of the transfer sheet 19, thereby contaminating the transfer sheet 19 and degrading the image quality. In the fixing device 30 according to the present embodiment, therefore, the toner transferred from the transfer sheet 19 to the surface of the fixing roller 31 is removed from the surface of the fixing roller 31 by the cleaning device 40.

Figure 3:
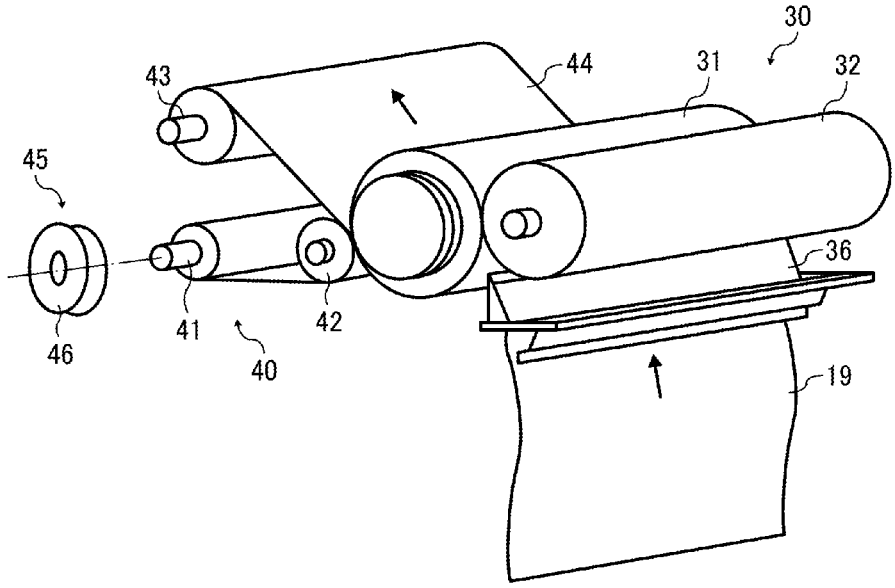
FIG. 3 is a perspective view illustrating a configuration of a cleaning device and a braking mechanism according to a first embodiment example.

The cleaning device 40 of the present embodiment adopts a web cleaning system using a web sheet 44 that slides against and cleans the surface of the fixing roller 31 as a cleaning target object. As illustrated in FIGS. 2 and 3, the cleaning device 40 includes a supply roller 41 and a reel roller 43. The supply roller 41 serves as a holding member holding the web sheet 44 wound therearound to be reeled out. The reel roller 43 serves as a reel member having the web sheet 44 wound therearound to be reeled in. The supply roller 41 has a shaft fixed to one end of the web sheet 44, and the reel roller 43 has a shaft fixed to the other one end of the web sheet 44. The cleaning device 40 further includes a pressing roller 42 that presses the web sheet 44 reeled out of the supply roller 41 against the fixing roller 31.

The supply roller 41, the pressing roller 42, and the reel roller 43 are rotatably supported by side plates of the fixing device 30 or the cleaning device 40. With one end of the shaft of the reel roller 43 connected to a drive device 90 via gears, as illustrated in FIG. 4, the reel roller 43 is driven to rotate counterclockwise in FIG. 2, as indicated by arrow R1.

Figure 4:
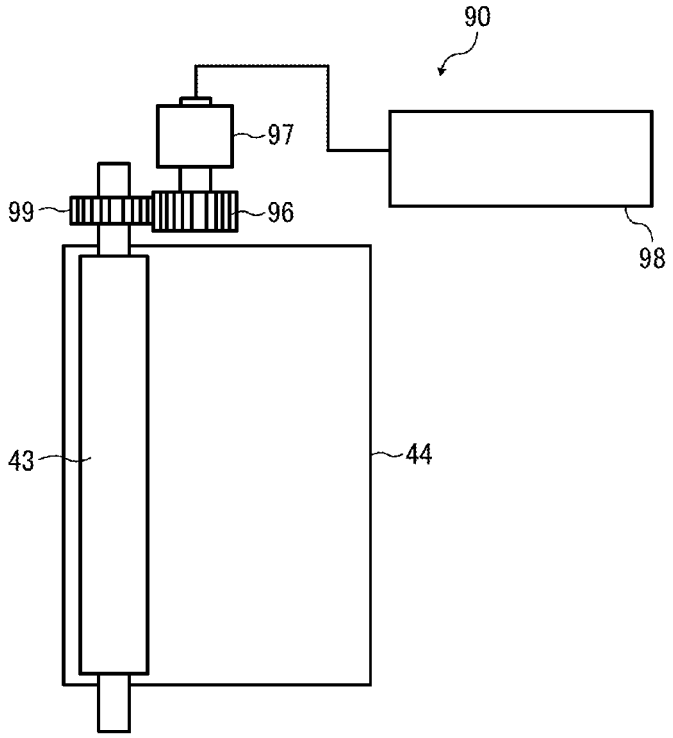
FIG. 4 is a schematic diagram illustrating a configuration of a drive device in the cleaning device.

FIG. 4 illustrates a configuration of the drive device 90 in the cleaning device 40. For clarity of illustration, the components of the cleaning device 40 other than the drive device 90 are omitted in the drawing except the reel roller 43. The drive device 90 includes a stepping motor 97 and a motor controller 98 that controls the stepping motor 97. As illustrated in FIG. 4, a reduction gear 96 fixed to a rotary shaft of the stepping motor 97 meshes with a gear 99 fitted around the shaft of the reel roller 43. The rotation of the stepping motor 97 is transmitted to the reel roller 43 via the reduction gear 96 and the gear 99 to wind the web sheet 44 around the reel roller 43.

When the reel roller 43 is thus driven to rotate, the web sheet 44 wound around the supply roller 41 passes through a web nip area, in which the pressing roller 42 and the fixing roller 31 are pressed against each other, with predetermined timing, to be reeled in around the reel roller 43.

The web sheet 44 may be made of an appropriately selected material, such as cloth, paper, resin sheet, resin film, or metal foil. In the present embodiment, the web sheet 44 has functions of sliding against and cleaning the surface of the fixing roller 31 and applying oil to the surface of the fixing roller 31. The web sheet 44, therefore, is made of a material impregnable with oil, such as nonwoven fabric formed of a mixture of aramid fiber and polyethylene terephthalate (PET) fiber, for example. When the web sheet 44 slides against the surface of the fixing roller 31, the oil impregnated in the web sheet 44 is thinly and uniformly applied to the surface of the fixing roller 31. The oil applied to the surface of the fixing roller 31 minimizes the transfer of toner from the transfer sheet 19 to the surface of the fixing roller 31, enhances the lubricity of the surface of the fixing roller 31, and minimizes friction on the surface of the fixing roller 31.

Prior to detailed description of the cleaning device 40 according to the present embodiment, a cleaning device 100 according to related art will now be described.

Figure 5:
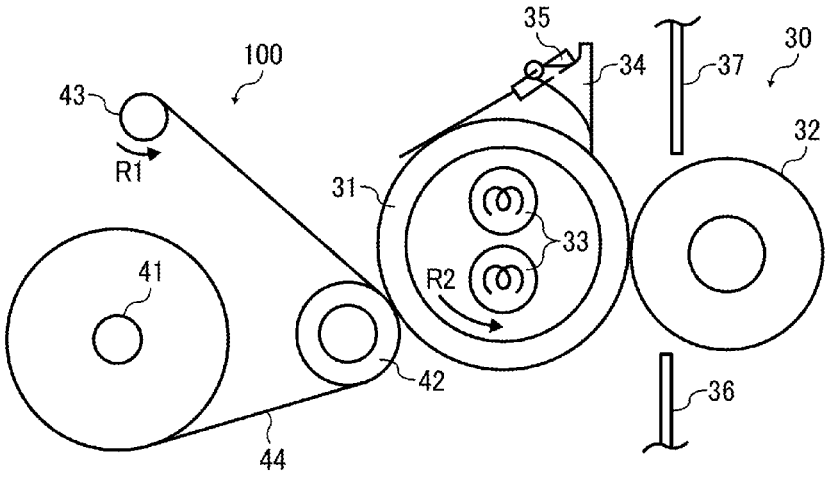
FIG. 5 RELATED ART
FIG. 5 is a schematic diagram illustrating a configuration of a fixing device and a cleaning device according to related art.

To prevent the adhesion of toner to the fixing roller 31, the cleaning device 100 also employs the web cleaning system using the web sheet 44 as the cleaning member, as illustrated in FIG. 5. In the cleaning device 100, the web sheet 44 is stretched between the supply roller 41 and the reel roller 43, and the thus-stretched portion of the web sheet 44 is pressed against the fixing roller 31 serving as the fixing member by the pressing roller 42 to clean the residual toner off the surface of the fixing roller 31 in the web nip area in which the web sheet 44 is pressed against the fixing roller 31. The reel roller 43 is rotated in a reel-in direction indicated by arrow R1 with predetermined timing to gradually move the web sheet 44 from the supply roller 41 toward the web nip area. In the cleaning device 100 employing such a web cleaning system, it is possible to clean the fixing roller 31 until the web sheet 44 runs out without substantial degradation of initial cleaning performance.

Herein, it is preferable that the reel-in direction of the web sheet 44 consumed in the cleaning is opposite to the moving direction of the fixing roller 31 indicated by arrow R2 for the following reasons.

The residual toner on the surface of the fixing roller 31 is removed on the front end side of the web nip area in which the web sheet 44 contacts with the fixing roller 31, i.e., on the upstream side of the web nip area in the moving direction of the surface of the fixing roller 31. The thus-removed toner is collected by the web sheet 44 on the upstream side of the web nip area. It is therefore preferable to reel in the web sheet 44 in a direction in which the toner collected by the web sheet 44 will not pass through the web nip area, i.e., the opposite direction to the moving direction of the surface of the fixing roller 31. If the web sheet 44 is reeled in in the same direction as the moving direction of the surface of the fixing roller 31, the toner collected by the web sheet 44 passes through the web nip area and may return to the fixing roller 31 during the passage through the web nip area, contaminating the surface of the fixing roller 31.

Further, in a low-temperature environment, the toner may be hardened and damage the fixing roller 31. Furthermore, if the web sheet 44, which has partially absorbed the toner and thus has an uneven thickness, passes through the web nip area, the pressure applied to the fixing roller 31 by the web sheet 44 becomes uneven, and thus frictional force on the web sheet 44 from the fixing roller 31 also becomes uneven, consequently causing creases in the web sheet 44 that may eventually rupture the web sheet 44.

Further, as a reverse rotation prevention mechanism for preventing a pressure roller from rotating in the opposite direction to the reel-in direction of a web sheet, a one-way clutch directly or indirectly coupled to a shaft of the pressure roller may be provided to the cleaning device. With the one-way clutch thus preventing the rotation of the pressure roller in the opposite direction to the reel-in direction of the web sheet, reverse movement of the web sheet is prevented.

Figure 6:
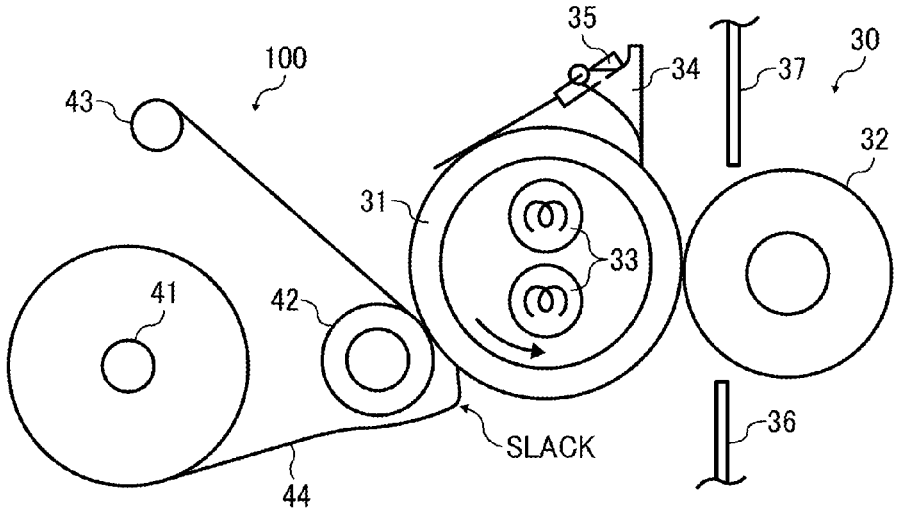
FIG. 6 RELATED ART
FIG. 6 is a schematic diagram illustrating slack in a web sheet in the cleaning device according to related art.

In the cleaning device 100 employing the related-art web cleaning system, however, there may be slack in the web sheet 44 reeled in around the reel roller 43, i.e., the web sheet 44 may be unevenly reeled in. If force in the opposite direction to the reel-in direction of the web sheet 44 acts on the web sheet 44 in the web nip area when there is such slack in the web sheet 44 reeled in around the reel roller 43, the slack web sheet 44 is pulled taut out of the reel roller 43 and moved in the reverse direction. As a result, the web sheet 44 is slackened near the web nip area, as illustrated in FIG. 6.

Figure 7:
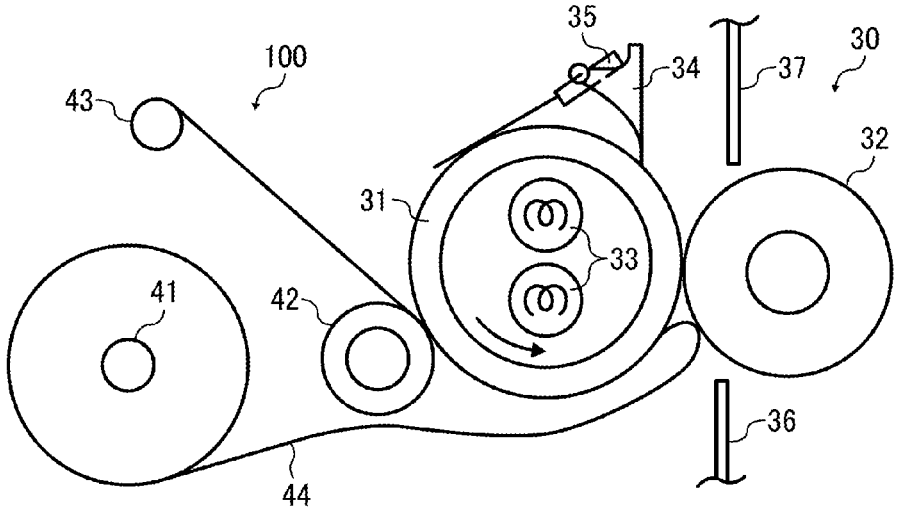
FIG. 7 RELATED ART
FIG. 7 is a schematic diagram illustrating increased slack in the web sheet in the cleaning device according to related art.

Although a small amount of slack of the web sheet 44 is negligible, if the reverse movement of the web sheet 44 continues, the collection of residual toner continues to take place at the same portion of the web sheet 44. If the collected toner exceeds the limit of the toner amount collectable by the web sheet 44, the toner collected by the web sheet 44 returns to the fixing roller 31, contaminating the surface thereof. Further, if the slack of the web sheet 44 is increased, the slack blocks the sheet transport path, as illustrated in FIG. 7, causing sheet jam. In this case, even removal of the jammed sheet will not clear the sheet feed failure.

As described above, the cleaning device including the one-way clutch as the reverse rotation prevention mechanism prevents the pressure roller from rotating in the opposite direction to the reel-in direction of the web sheet. However, an operation failure (i.e., lock failure) may occur in the one-way clutch if the one-way clutch is left unlocked for an extended time. The incidence rate of failure of the one-way clutch is particularly high when the unlocked one-way clutch is subjected to pressure from the pressure roller, left for an extended period of time with no operation of the cleaning device, or left in a low-temperature environment, for example.

One-way clutch failure results in failure to prevent the pressure roller from rotating in the opposite direction to the web sheet reel-in direction. If any pulling force acts on the web sheet when there is slack in the web sheet reeled in around the reel roller and the one-way clutch fails, therefore, the slack web sheet is pulled taut out of the reel roller and moved in the reverse direction, as described above. The reverse movement of the web sheet, however, will not occur even when the one-way clutch fails, if there is no slack in the web sheet. It is therefore also preferable in the cleaning device equipped with the above-described one-way clutch that there be no slack in the web sheet reeled in around the reel roller.

Figure 8:
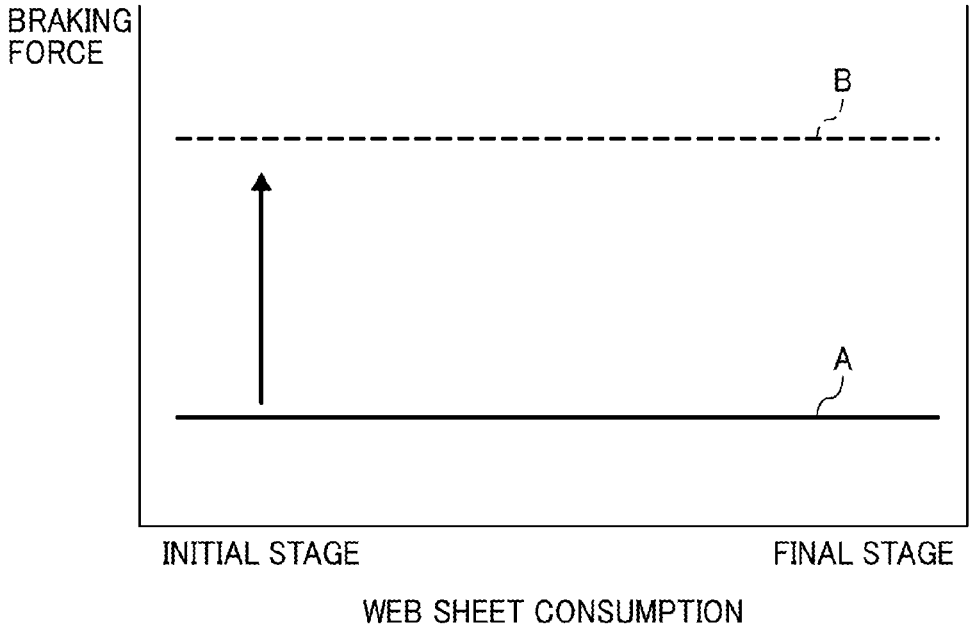
FIG. 8 RELATED ART
FIG. 8 is a diagram illustrating the relationship between web sheet consumption and braking force in the cleaning device according to the related art.

To reel in the consumed portion of the web sheet 4 around the reel roller 43 with no slack, it is necessary to set the force for pulling the web sheet 44 in the opposite direction to the reel-in direction (hereinafter referred to as back tension) to an appropriate level greater than the force for pulling the web sheet 44 in the reel-in direction during a reel-in operation. Forces acting as the back tension include pressure applied to the web sheet 44 by the pressing roller 42 to press the web sheet 44 against the fixing roller 31 in the web nip area and frictional force caused when the rotating fixing roller 31 slides against the web sheet 44. The back tension combining these forces applied to the web sheet 44 in the web nip area remains constant over time, as indicated by a solid line A in FIG. 8.

As a device for applying further back tension, a braking mechanism serving as a rotational load-applying device for applying a load to the rotation of the supply roller 41 may be provided. For example, in a braking mechanism 400 illustrated in FIGS. 9A and 9B, a biasing member 102 biases a pressing member 101, which is made of rubber or the like and thus capable of providing frictional force, against the rotary shaft of the supply roller 41 or another shaft connected to the supply roller 41 to transmit drive force (hereinafter simply referred to as the shaft), to thereby apply a load to the shaft of the supply roller 41. It is possible to adjust the load thus applied to the shaft of the supply roller 41 by adjusting the material of the pressing member 101 and the biasing force of the biasing member 102 biasing the pressing member 101. Back tension including this load, which is indicated by a broken line B in FIG. 8, remains substantially constant over time and is greater than the back tension indicated by the solid line A.

Figure 10:
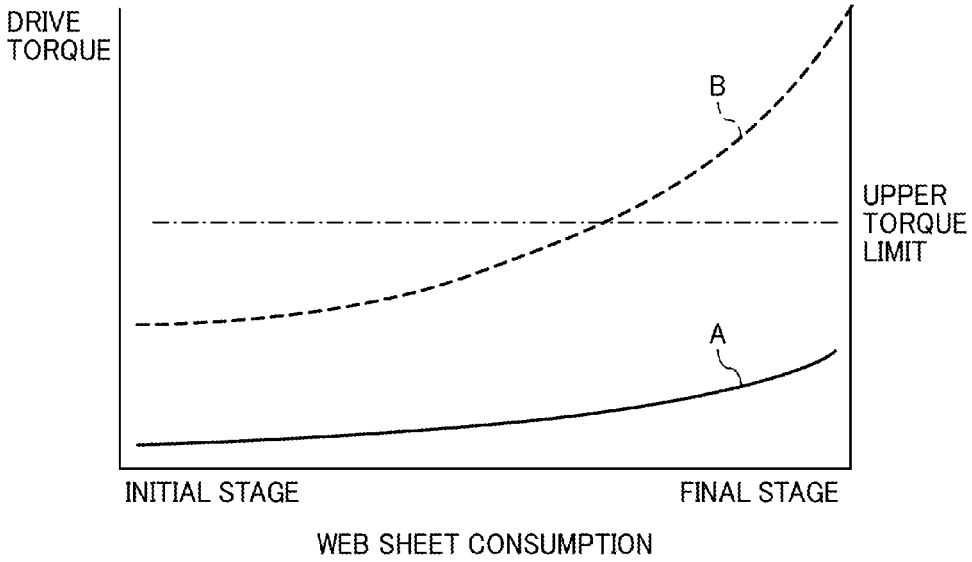
FIG. 10 RELATED ART
FIG. 10 is a diagram illustrating the relationship between web sheet consumption and drive torque in the cleaning device according to the related art.

When a load is applied to the shaft of the supply roller 41, the force for reeling in the web sheet 44 around the shaft of the reel roller 43, i.e., drive torque or force necessary for driving the reel roller 43, differs substantially between an initial stage and a final stage of consumption of the web sheet 44. Even if the back tension, i.e., the resultant of the load applied to the shaft of the supply roller 41 and the force applied to the web sheet 44 in the web nip area, remains constant, the force necessary for driving the reel roller 43 gradually increases with the consumption of the web sheet 44, i.e., with a gradual increase in outer diameter of the reel roller 43 (including the thickness of the web sheet 44 wound therearound) and a gradual reduction in outer diameter of the supply roller 41 (including the thickness of the wound web sheet 44 wound therearound). As illustrated in FIG. 10, the force necessary for driving the reel roller 43 when a load is applied to the shaft of the supply roller 41 increases in a quadratic curve as indicated by a broken line B, whereas the force necessary for driving the reel roller 43 when a load is not applied to the shaft of the supply roller 41 increases as indicated by a solid line A.

This is due to the following reasons. The first reason is that the moment on the shaft of the reel roller 43 is increased with the increase of the outer diameter of the reel roller 43 due to the consumption of the web sheet 44. For example, if the shaft (i.e., core rod) of the reel roller 43 has an outer diameter of 8 mm and the reel roller 43 after consumption of the web sheet 44 has an outer diameter of 32 mm, the force acting on the shaft of the reel roller 43 after the consumption of the web sheet 44 is four times greater than the initial force, even if back tension remains constant. The second reason is that, if the outer diameter of the supply roller 41 is reduced with the consumption of the web sheet 44, the force for reeling out the web sheet 44 from the supply roller 41 against the load applied to the shaft of the supply roller 41 is increased depending on the change in moment. For example, if the supply roller 41 in the initial stage of consumption of the web sheet 44 has an outer diameter of 32 mm and the shaft of the supply roller 41 after the consumption of the web sheet 44 has an outer diameter of 8 mm, the force for reeling out the web sheet 44 from the supply roller 41 after the consumption of the web sheet 44 is four times greater the initial force, even if the load on the shaft of the supply roller 41 remains constant. Due to the two reasons described above, the drive torque or drive force necessary for reeling in the web sheet 44 around the reel roller 43 at the end of consumption of the web sheet 44 is 16 times the drive torque necessary for reeling in the web sheet 44 around the reel roller 43 at the start of consumption of the web sheet 44. That is, with the consumption of the web sheet 44, the drive torque or drive force necessary for reeling in the web sheet 44 increases by the square thereof with the change in diameter of the supply roller 41 and the reel roller 43.

If the back tension for reeling in the web sheet 44 without slack is thus provided by the braking mechanism 400 that applies a constant load to the shaft of the supply roller 41, the drive force for driving the reel roller 43 is excessively increased with the consumption of the web sheet 44, as described above. In the braking mechanism 400 that applies a constant load to the shaft of the supply roller 41, therefore, a drive motor serving as a drive source for the reel roller 43 needs to be increased in size, which increases the cost and size of the cleaning device.

To address the above-described issues, the cleaning device 40 according to the present embodiment includes, as a device that applies back tension to the web sheet 44, a braking mechanism described in detail below that serves as a rotational load-applying device for applying a load to the rotation of the supply roller 41 and changes the braking force depending on the amount of the web sheet 44 held by the supply roller 41. That is, when the amount of the web sheet 44 held by the supply roller 41 is large, the braking force of the braking mechanism is high, and high back tension is applied to the web sheet 44. With a reduction in the amount of the web sheet 44 held by the supply roller 41, the braking force of the braking mechanism is reduced, thereby reducing the back tension applied to the web sheet 44. Accordingly, slack (i.e., uneven reel-in) of the web sheet 44 reeled in around the reel roller 43 is reduced compared with the configuration which applies back tension based on a constant load. Consequently, the braking mechanism according to the present embodiment is capable of minimizing the reverse movement of the web sheet 44 due to the slack of the web sheet 44.

Description will now be given based on specific embodiment examples. A first embodiment example will now be described.

Figure 11A:
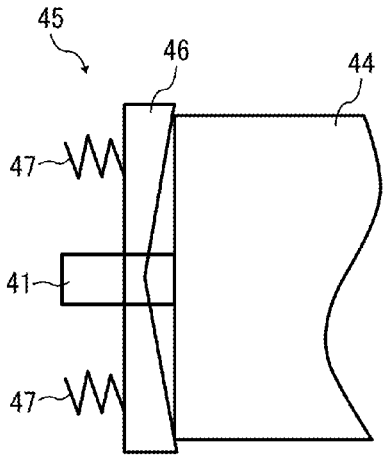
FIG. 11A is a schematic diagram illustrating an initial state of web sheet supply by the cleaning device and the braking mechanism according to the first embodiment example.
Figure 11B:
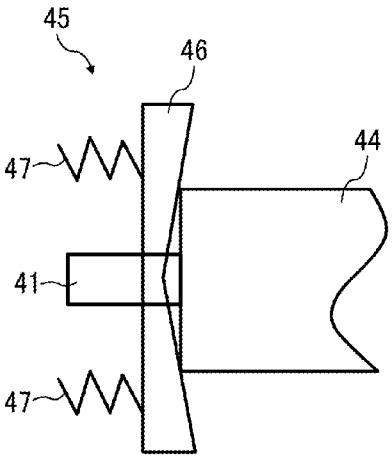
FIG. 11B is a schematic diagram illustrating a final state of web sheet supply by the cleaning device and the braking mechanism according to the first embodiment example.

FIG. 3 is a perspective view illustrating a configuration of the cleaning device 40 and a braking mechanism 45 according to the first embodiment example. FIG. 11A is a schematic diagram illustrating an initial state of web sheet supply by the cleaning device 40 and the braking mechanism 45. FIG. 11B is a schematic diagram illustrating a final state of web sheet supply by the cleaning device 40 and the braking mechanism 45. The braking mechanism 45 illustrated in FIG. 3 and FIGS. 11A and 11B includes first braking members 46 and springs 47. The first braking members 46 come into contact with end surfaces of the web sheet 44 wound around the supply roller 41 to apply a load to the rotation of the supply roller 41. The springs 47 are elastic members. It is to be noted that although FIG. 3 and FIGS. 11A and 11B only illustrate the first braking member 46 and the springs 47 provided to one end portion of the supply roller 41, each of opposed end portions of the supply roller 41 is provided with the first braking member 46 and the springs 47.

As illustrated in FIG. 3 and FIGS. 11A and 11B, the first braking member 46 is coaxially disposed to each of the opposed end portions of the shaft of the supply roller 41. While in contact with an end surface of the web sheet 44 wound around the supply roller 41, the first braking member 46 is held to be movable in the axial direction of the supply roller 41. As illustrated in FIGS. 11A and 11B, the first braking member 46 has a contact surface contacting with the web sheet 44 wound around the supply roller 41. In cross-section, the contact surface is formed in a tapered shape that moves away from the end surface of the web sheet 44 toward the center of rotation. The plurality of springs 47 are disposed at regular intervals in the circumferential direction of the first braking member 46. Each of the springs 47 has one end fixed to, for example, a side plate of the fixing device 30 or the cleaning device 40 and the other end attached to the first braking member 46. Thereby, the first braking member 46 is biased against the web sheet 44 wound around the supply roller 41 by the elastic force of the springs 47.

In the above-described braking mechanism 45, as the diameter of the supply roller 41 is reduced with the consumption of the web sheet 44, the first braking member 46 having the tapered surface is moved toward the center in the axial direction of the supply roller 41 by the elastic force of the springs 47. With an increase of the working distance of the springs 47, the deformation amount of the springs 47 is reduced, and the elastic force of the springs 47 is also reduced. That is, with the consumption of the web sheet 44, the braking force applied to the end surface of the web sheet 44 wound around the supply roller 41 by the first braking member 46 biased by the springs 47 is gradually reduced. With the first braking member 46, therefore, it is possible to control the braking force applied to the supply roller 41 so that the braking force changes depending on the amount of the web sheet 44 wound around and held by the supply roller 41 with a simple, low-cost, and space-saving configuration. The braking force (i.e., load) may be optimized by adjusting the pressure and the spring constant of the springs 47, the tapered shape of the first braking member 46, or both.

It is conceivable to provide the shaft of the supply roller 41 with a variable load braking mechanism, such as a solenoid or a stepping motor, as a rotational load-applying device that applies a variable load to the rotation of the supply roller 41. The use of a solenoid, a stepping motor, or the like, however, increases cost and space for installation. Contrastively, the braking mechanism 45 including the first braking members 46 and the springs 47 is capable of changing the load applied to the rotation of the supply roller 41 with a low-cost, space-saving configuration.

Figure 12:
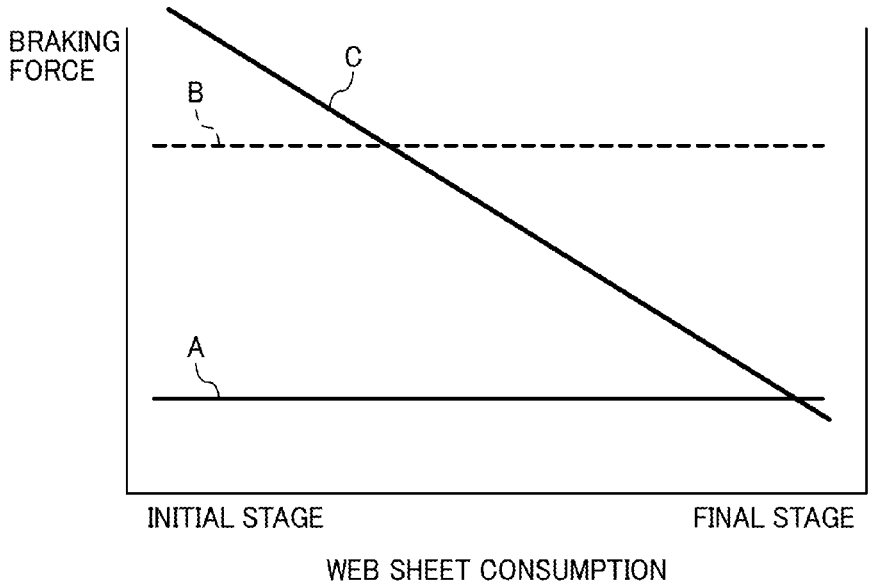
FIG. 12 is a diagram illustrating the relationship between web sheet consumption and braking force in the cleaning device according to the first embodiment example.
Figure 13:
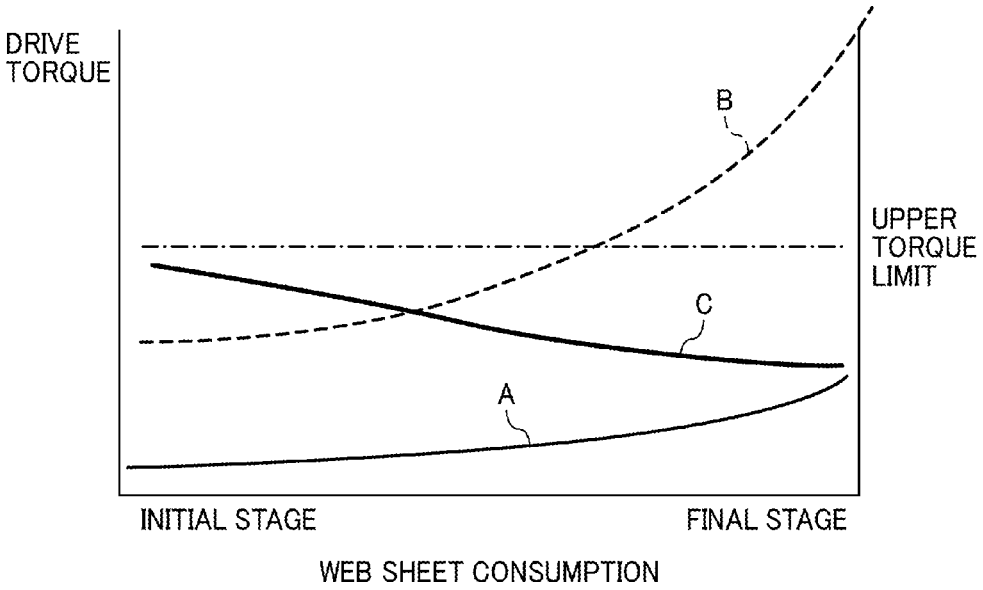
FIG. 13 is a diagram illustrating the relationship between web sheet consumption and drive torque in the cleaning device according to the first embodiment example.

FIG. 12 is a diagram illustrating the relationship between the web sheet consumption and the braking force. FIG. 13 is a diagram illustrating the relationship between the web sheet consumption and the drive torque. A solid line A in FIGS. 12 and 13 indicates a characteristic obtained when the back tension consists only of the braking force applied to the web sheet 44 in the web nip area. A broken line B in FIGS. 12 and 13 indicates a characteristic obtained by the use of a braking mechanism that presses pressing members against the shaft of a supply roller.

As indicated by a thick solid line C in FIG. 12, in the braking mechanism 45 including the first braking members 46 and the springs 47, the braking force is gradually reduced with the consumption of the web sheet 44, as described above. Further, due to the gradual reduction of the braking force in the braking mechanism 45, the drive torque necessary for driving the supply roller 41 is not increased with the consumption of the web sheet 44, as indicated by a thick solid line C in FIG. 13. Accordingly, a drive device serving as a drive source for the supply roller 41 does not require large drive force, and thus may be configured in a small space at low cost.

A second embodiment example will now be described.

Figure 14:
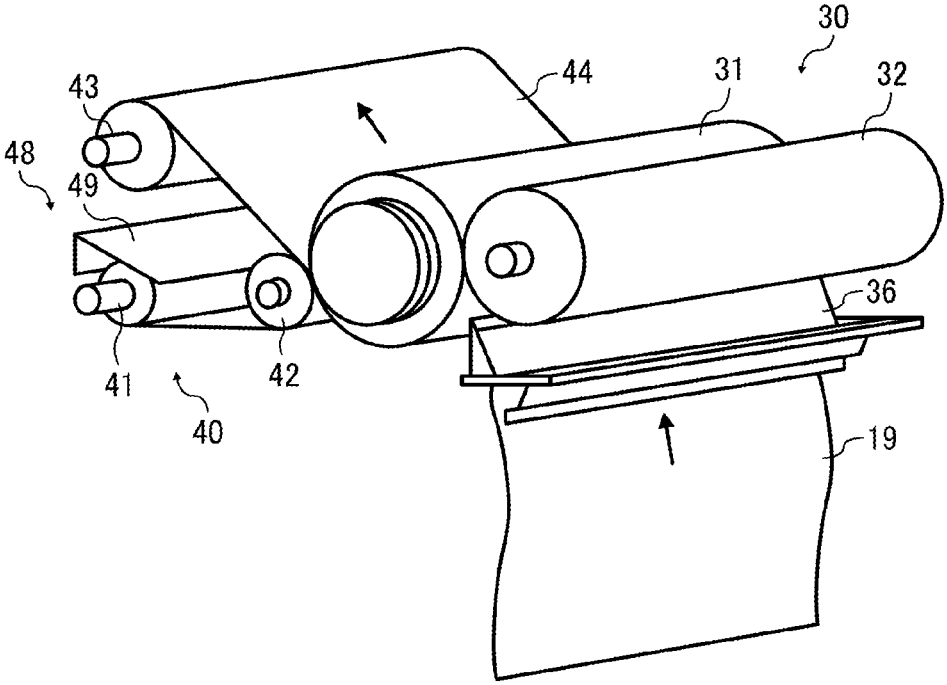
FIG. 14 is a perspective view illustrating a configuration of a cleaning device and a braking mechanism according to a second embodiment example.
Figure 15A:
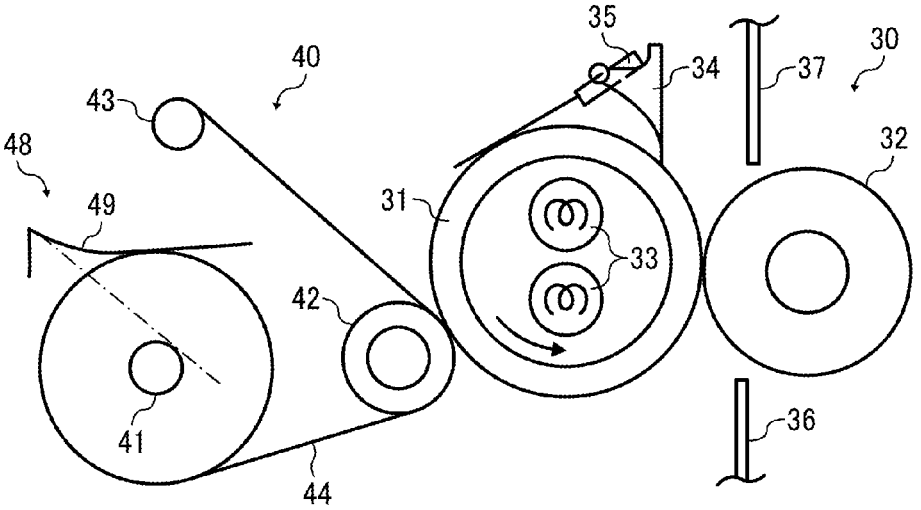
FIG. 15A is a schematic diagram illustrating an initial state of web sheet supply by the cleaning device and the braking mechanism according to the second embodiment example.
Figure 15B:
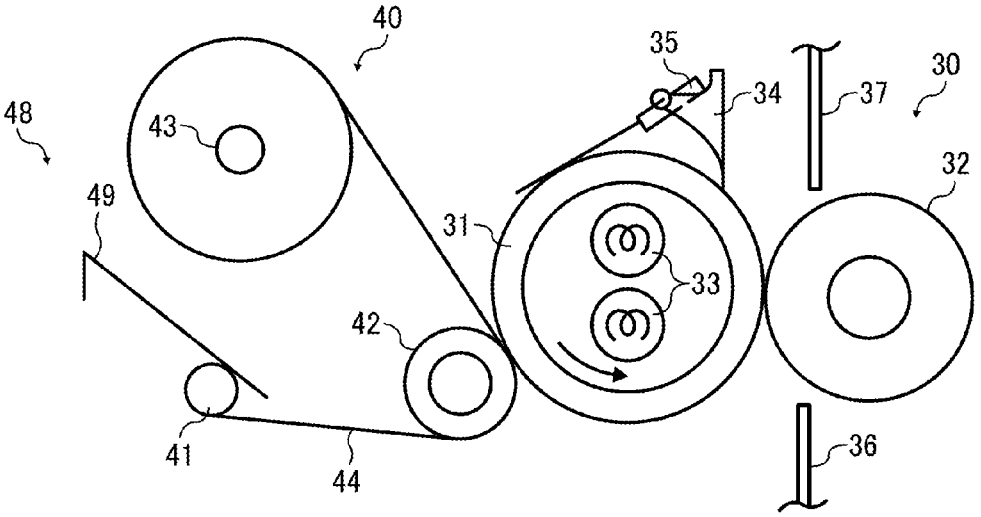
FIG. 15B is a schematic diagram illustrating a final state of web sheet supply by the cleaning device and the braking mechanism according to the second embodiment example.

FIG. 14 is a perspective view illustrating a configuration of the cleaning device 40 and a braking mechanism 48 according to the second embodiment example. FIG. 15A is a schematic diagram illustrating an initial state of web sheet supply by the cleaning device 40 and the braking mechanism 48. FIG. 15B is a schematic diagram illustrating a final state of web sheet supply by the cleaning device 40 and the braking mechanism 48. The braking mechanism 48 illustrated in FIG. 14 and FIGS. 15A and 15B includes a second braking member 49 that comes into contact with the outer circumferential surface of the web sheet 44 wound around the supply roller 41 to apply a load to the rotation of the supply roller 41. Components or parts in FIG. 14 and FIGS. 15A and 15B identical with or corresponding to those in the previous drawings are designated by the same reference numerals, and redundant description thereof will be omitted where appropriate.

As illustrated in FIG. 14, the second braking member 49 is a leaf spring having a width substantially the same as the width of the web sheet 44. Further, the second braking member 49 has one end fixed to a side plate of the fixing device 30 or the cleaning device 40 and the other end (i.e., free end) kept in contact with the outer circumferential surface of the web sheet 44 wound around the supply roller 41 by the elastic force of the second braking member 49. As illustrated in FIG. 15A, if the amount of the web sheet 44 wound around the supply roller 41 is large, the deformation amount of the second braking member 49 is large, and thus contact pressure (i.e., braking force) applied by the second braking member 49 is high. Further, as illustrated in FIG. 15B, as the amount of the web sheet 44 wound around the supply roller 41 is reduced with the consumption of the web sheet 44, the deformation amount of the second braking member 49 is reduced, thereby reducing the contact pressure (i.e., braking force) applied by the second braking member 49.

As described above, in the braking mechanism 48 including the second braking member 49, if the diameter of the supply roller 41 is reduced with the consumption of the web sheet 44, the braking force applied to the web sheet 44 wound around the supply roller 41 is also gradually reduced. With the braking mechanism 48, therefore, it is possible control the braking force applied to the supply roller 41 to change depending on the amount of the web sheet 44 held by the supply roller 41 with a simple, low-cost, and space-saving configuration. The braking force (i.e., load) may be optimized by adjusting the pressure and the spring constant of the second braking member 49 (i.e., leaf spring).

Further, in the braking mechanism 48 including the second braking member 49, the braking force is gradually reduced with the consumption of the web sheet 44, and thus the drive torque necessary for driving the reel roller 43 is not increased similarly to the case described with reference to FIGS. 12 and 13. The drive device serving as the drive source for the supply roller 41, therefore, does not require large drive force, and thus may be configured in a small space at low cost.

A third embodiment example will now be described.

Figure 16A:
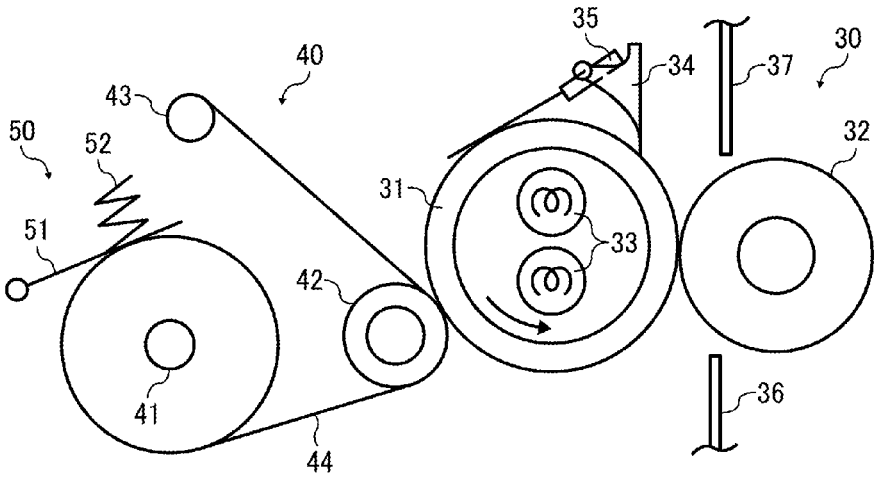
FIG. 16A is a schematic diagram illustrating an initial state of web sheet supply by a cleaning device and a braking mechanism according to a third embodiment example.
Figure 16B:
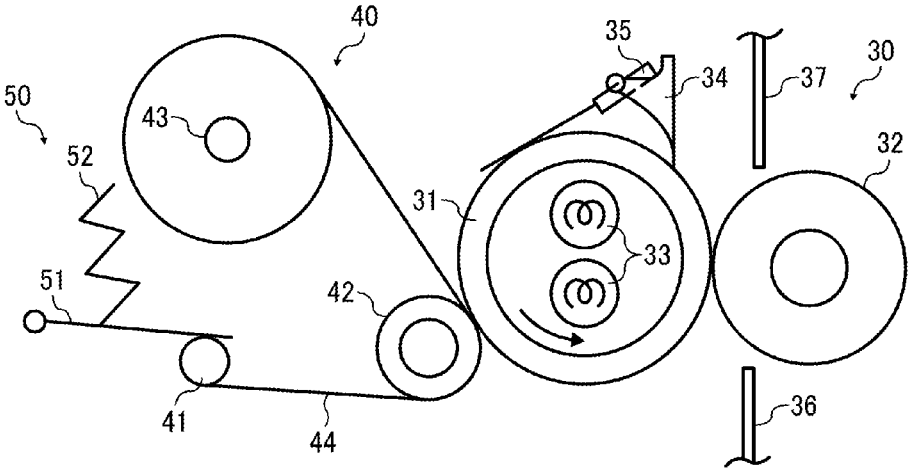
FIG. 16B is a schematic diagram illustrating a final state of web sheet supply by the cleaning device and the braking mechanism according to the third embodiment example.

FIG. 16A is a schematic diagram illustrating an initial state of web sheet supply by the cleaning device 40 and a braking mechanism 50 according to the third embodiment example. FIG. 16B is a schematic diagram illustrating a final state of web sheet supply by the cleaning device 40 and the braking mechanism 50. The braking mechanism 50 illustrated in FIGS. 16A and 16B includes a third braking member 51 and a spring 52. The third braking member 51 comes into contact with the outer circumferential surface of the web sheet 44 wound around the supply roller 41 to apply a load to the rotation of the supply roller 41. The spring 52 is an elastic member that biases the third braking member 51. Components or parts in FIGS. 16A and 16B identical with or corresponding to those in the previous drawings are designated by the same reference numerals, and redundant description thereof will be omitted where appropriate.

As illustrated in FIGS. 16A and 16B, the third braking member 51 has the shape of a plate having a width substantially the same as the width of the web sheet 44. Further, the third braking member 51 has one end fixed to a side plate of the fixing device 30 or the like and the other end (i.e., free end) in contact with the outer circumferential surface of the web sheet 44 wound around the supply roller 41. The spring 52 has one end fixed to a side plate of the fixing device 30 or the cleaning device 40 and the other end (i.e., free end) attached to the third braking member 51. The spring 52 uses the elastic force thereof to bias the third braking member 51 in contact with the outer circumferential surface of the web sheet 44 toward the supply roller 41. As illustrated in FIG. 16A, if the amount of the web sheet 44 wound around the supply roller 41 is large, the deformation amount of the spring 52 is large, and the contact pressure (i.e., braking force) applied by the third braking member 51 is high. Further, as illustrated in FIG. 16B, the deformation amount of the spring 52 is reduced with the consumption of the web sheet 44, thereby reducing the contact pressure (i.e., braking force) applied by the third braking member 51.

As described above, in the braking mechanism 50 including the third braking member 51 and the spring 52, the braking force applied to the web sheet 44 wound around the supply roller 41 is gradually reduced with the consumption of the web sheet 44. With the braking mechanism 50, therefore, it is possible to control the braking force applied to the supply roller 41 to change depending on the amount of the web sheet 44 held by the supply roller 41 with a simple, low-cost, and space-saving configuration. The braking force (i.e., load) may be optimized by adjusting the pressure and the spring constant of the spring 52.

Further, in the braking mechanism 50 including the third braking member 51 and the spring 52, the braking force is gradually reduced with the consumption of the web sheet 44, and thus the drive torque necessary for driving the reel roller 43 is not increased similarly to the case described with reference to FIGS. 12 and 13. The drive device serving as the drive source for the supply roller 41, therefore, does not require large drive force, and thus may be configured in a small space at low cost.

A fourth embodiment example will now be described.

Figure 17:
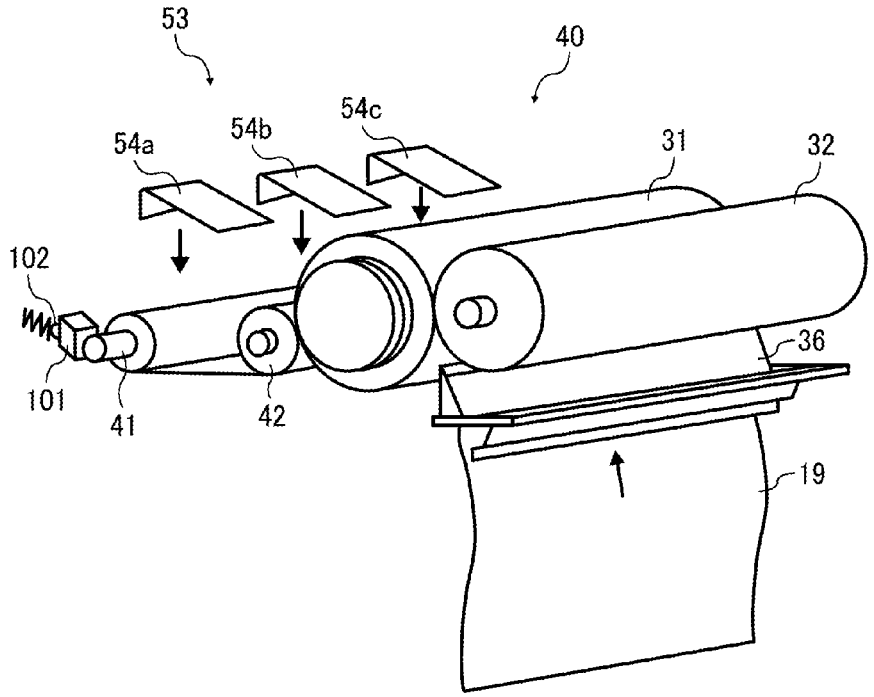
FIG. 17 is a perspective view illustrating a configuration of a cleaning device and a braking mechanism according to a fourth embodiment example.
Figure 18:
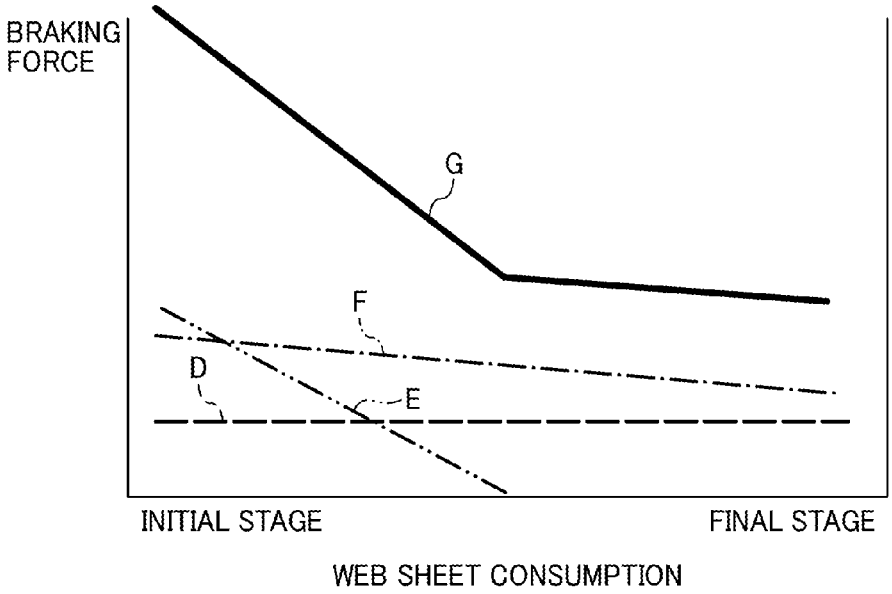
FIG. 18 is a diagram illustrating the relationship between web sheet consumption and braking force in the cleaning device according to the fourth embodiment example.
Figure 19:
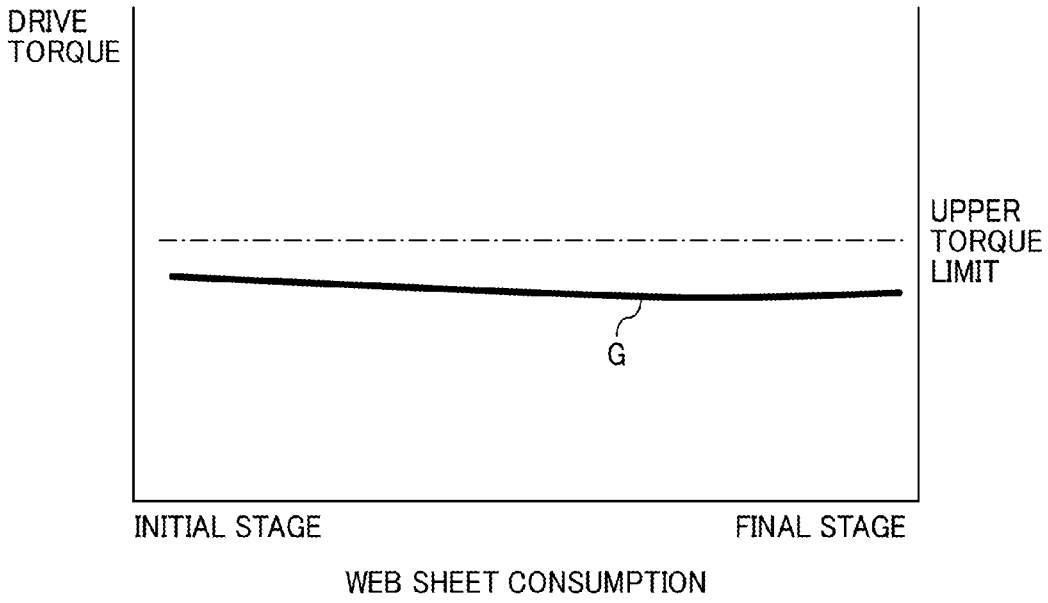
FIG. 19 is a diagram illustrating the relationship between web sheet consumption and drive torque in the cleaning device according to the fourth embodiment example.

A braking mechanism 53 according to the fourth embodiment example includes a plurality of fourth braking members 54*a*, 54*b*, and 54*c* having different braking forces. FIG. 17 is a perspective view illustrating a configuration of the cleaning device 40 and the braking mechanism 53 according to the fourth embodiment example. Although the reel roller 43 and a part of the web sheet 44 are omitted in the drawing for clarity of illustration, the cleaning device 40 in this embodiment example includes the reel roller 43 and the web sheet 44 similarly to the foregoing embodiment examples. FIG. 18 is a diagram illustrating the relationship between the web sheet consumption and the braking force. FIG. 19 is a diagram illustrating the relationship between the web sheet consumption and the drive torque. Components or parts in FIGS. 17 to 19 identical with or corresponding to those in the previous drawings are designated by the same reference numerals, and redundant description thereof will be omitted where appropriate.

Figure 9A:
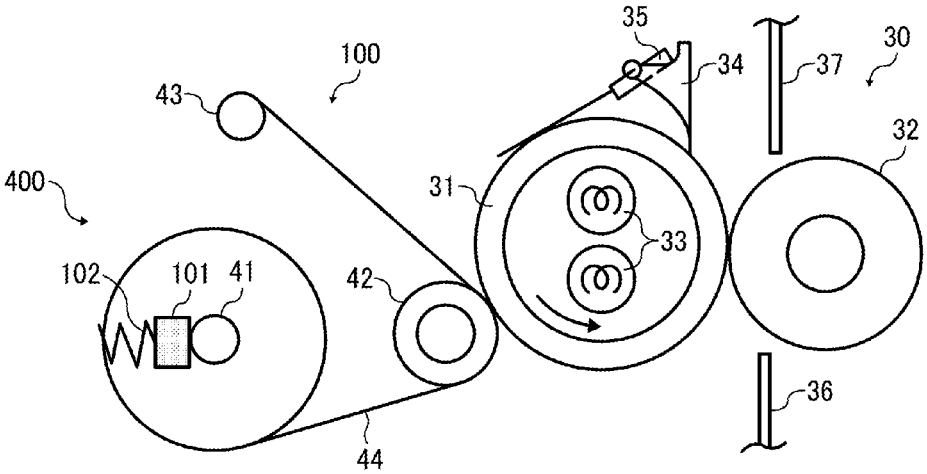
FIG. 9A RELATED ART
FIG. 9A is a schematic diagram illustrating an initial state of web sheet supply by the cleaning device and a braking mechanism according to the related art.
Figure 9B:
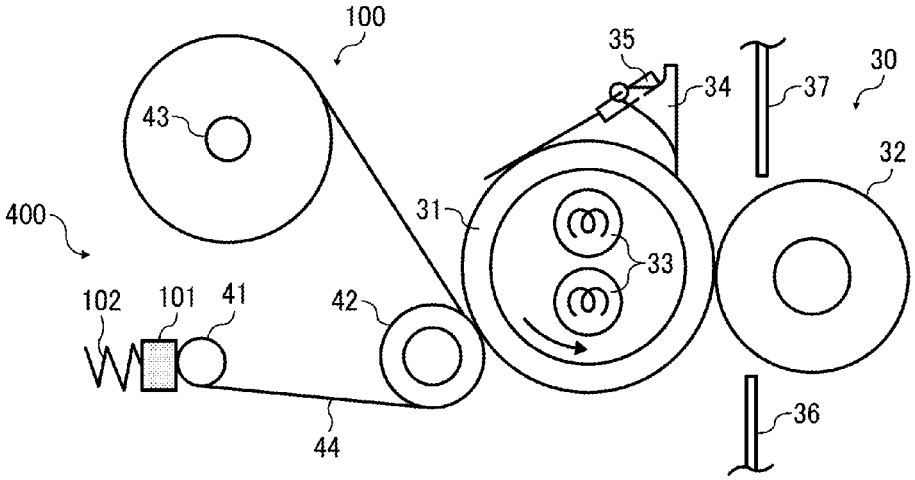
FIG. 9B RELATED ART
FIG. 9B is a schematic diagram illustrating a final state of web sheet supply by the cleaning device and the braking mechanism according to the related art.

In the braking mechanism 53 according to the fourth embodiment, the pressing member 101 having frictional force is pressed against each of opposed ends of the rotary shaft of the supply roller 41 similarly to the configuration illustrated in FIGS. 9A and 9B. The pressing member 101 applies constant braking force to the supply roller 41, as indicated by a solid line D in FIG. 18. Further, in the braking mechanism 53, the plurality of fourth braking members 54*a*, 54*b*, and 54*c*, being leaf springs, are arranged along the axial direction of the supply roller 41 to come into contact with the outer circumferential surface of the web sheet 44 wound around the supply roller 41 to apply a load to the rotation of the supply roller 41, as illustrated in FIG. 17. Each of the fourth braking members 54*a*, 54*b*, and 54*c* has one end fixed to a side plate of the fixing device 30 or the cleaning device 40 and the other end (i.e., free end) kept in contact with the outer circumferential surface of the web sheet 44 wound around the supply roller 41 by the elastic force thereof.

As indicated by a solid line E in FIG. 18, the fourth braking members 54*a* and 54*c* located near the opposed end portions in the axial direction of the supply roller 41 have high braking force in an initial stage of consumption of the web sheet 44, in which the amount of the web sheet 44 wound around the supply roller 41 is large, and lose the braking force in an intermediate stage of consumption of the web sheet 44, in which the amount of the web sheet 44 wound around the supply roller 41 is reduced to approximately a half Meanwhile, the fourth braking member 54*b* located near a central portion in the axial direction of the supply roller 41 is in contact with the web sheet 44 at a smaller angle than the fourth braking members 54*a* and 54*c*. As indicated by a solid line F in FIG. 18, therefore, the fourth braking member 54*b* has low braking force in the initial stage of consumption of the web sheet 44, but maintains the braking force until a final stage of consumption of the web sheet 44, i.e., until the web sheet 44 wound around the supply roller 41 runs out. That is, while the braking force of the pressing member 101 indicated by the solid line D remains constant, the braking force of the fourth braking members 54*a* and 54*c* indicated by the solid line E and the braking force of the fourth braking member 54*b* indicated by the solid line F are gradually reduced.

As described above, in the braking mechanism 53 according to the fourth embodiment example, the resultant of the forces of the pressing member 101 and the fourth braking members 54*a*, 54*b*, and 54*c* acts in the initial stage of consumption of the web sheet 44, applying large braking force on the supply roller 41, as indicated by a thick solid line G in FIG. 18. In the initial stage of consumption of the web sheet 44, the drive torque is sufficiently high to apply large braking force. In the intermediate stage of consumption of the web sheet 44, the braking forces of the fourth braking members 54*a* and 54*c* are reduced to apply the braking force while suppressing the increase of the drive torque. In the final stage of consumption of the web sheet 44, the braking forces of the pressing member 101 and the fourth braking members 54*a*, 54*b*, and 54*c* are reduced, but the resultant of the braking forces is applied such that the drive torque will not exceed an upper limit, as indicated by a thick solid line G in FIG. 19. If the initial values of the braking forces of the fourth braking members 54*a*, 54*b*, and 54*c* and the combination of different spring constants of the fourth braking members 54*a*, 54*b*, and 54*c* are optimized, maximum possible braking force is maintained from the initial to final stages of consumption of the web sheet 44 within the upper limit of the drive torque.

In the above-described embodiment example, the fourth braking members 54*a* and 54*c* disposed near the opposed end portions in the axial direction of the supply roller 41 are set to have high braking force in the initial stage of consumption of the web sheet 44, and the fourth braking member 54*b* disposed near the central portion in the axial direction of the supply roller 41 is set to maintain the braking force from the initial to final stages of consumption of the web sheet 44. Alternatively, the braking forces may be set vice versa. Further, although the above-described embodiment example uses the three divided fourth braking members 54*a*, 54*b*, and 54*c* arranged along the axial direction of the supply roller 41, the number of divided braking members is not limited to three.

Description will now be given of a configuration of a cleaning device 60 according to another embodiment.

Figure 20:
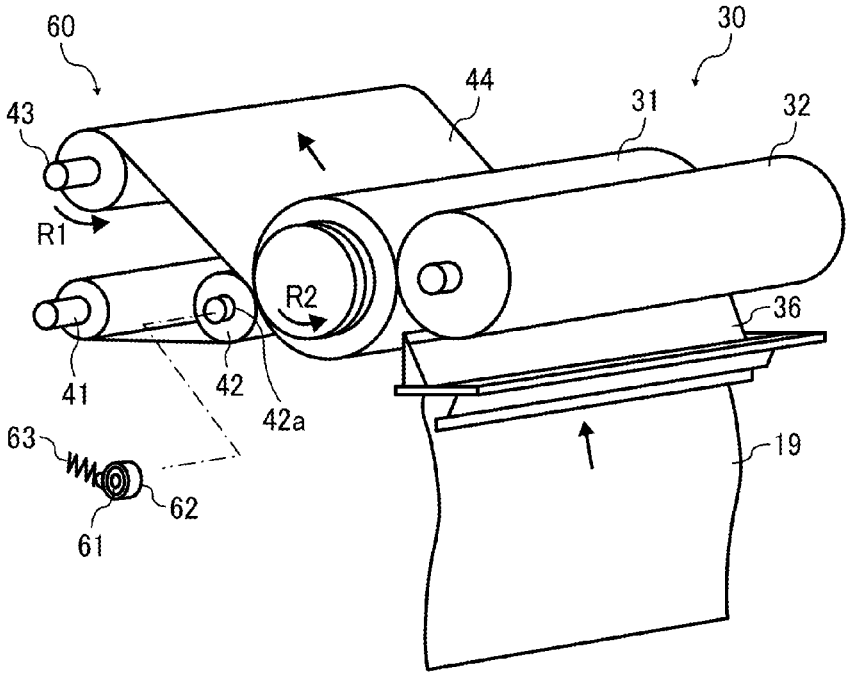
FIG. 20 is a perspective view illustrating a configuration of a cleaning device according to another embodiment of this disclosure.

FIG. 20 is a perspective view illustrating a configuration of the cleaning device 60 according to the another embodiment. As illustrated in FIG. 20, the cleaning device 60 according to the present embodiment includes one-way clutches 61 as a reverse rotation prevention mechanism that prevents the rotation of the pressing roller 42 in the opposite direction to the reel-in direction of the web sheet 44. The one-way clutches 61 are respectively housed in shaft bearings 62 that rotatably hold a shaft 42*a* of the pressing roller 42. Although FIG. 20 only illustrates the one-way clutch 61 and the shaft bearing 62 provided to one end portion of the shaft 42*a* of the pressing roller 42, each of opposed end portions of the shaft 42*a* of the pressing roller 42 is provided with the one-way clutch 61 and the shaft bearing 62.

Figure 21A:
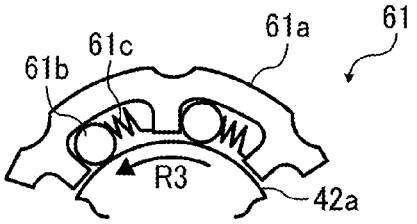
FIGS. 21 A and 21B are partial cross-sectional views of an example of the internal structure of a one-way clutch in the cleaning device in FIG. 19.
Figure 21B:
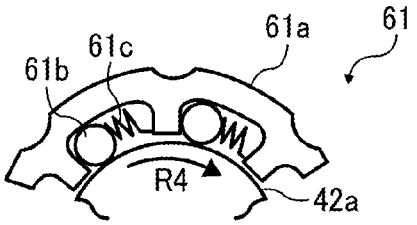
Figure 22:
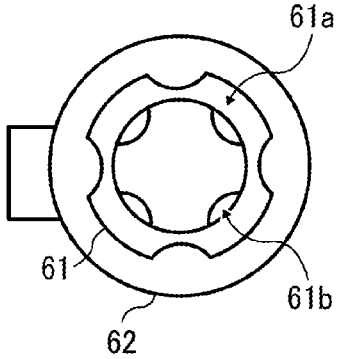
FIG. 22 is a schematic diagram illustrating a configuration of a shaft bearing housing the one-way clutch.

FIGS. 21A and 21B are partial cross-sectional views of an example of the internal structure of the one-way clutch 61. FIG. 22 is a schematic diagram illustrating a configuration of the shaft bearing 62 housing the one-way clutch 61. The one-way clutch 61 illustrated in FIGS. 21A and 21B and FIG. 22 includes an outer ring 61*a* rotatably fitted around the outer circumference of the shaft 42*a* of the pressing roller 42, rollers 61*b* stored in recesses formed in an inner circumferential portion of the outer ring 61*a*, and springs 61*c* that bias the rollers 61*b*. The shaft bearing 62 is provided to a side wall of the fixing device 30 and biased by a spring 63 to press the pressing roller 42 against the fixing roller 31.

The above-configured one-way clutch 61 has the following operational states.

In state 1, in which the reel roller 43 is rotating in the direction of arrow R1, the one-way clutch 61 is unlocked, running idle, as illustrated in FIGS. 20 and 21B. As illustrated in FIG. 21B, if the shaft 42*a* of the pressing roller 42 rotates in the direction of arrow R4 in the drawing, the rollers 61*b* separate from the inner circumferential surface of the recesses of the outer ring 61*a* against the biasing force of the springs 61*c*, making the shaft 42*a* running idle, not engaged with the outer ring 61*a*.

In state 2, in which the reel roller 43 and the fixing roller 31 are stopped, the one-way clutch 61 is kept in a neutral state (i.e., pre-operation state).

In state 3, in which the reel roller 43 is stopped and the fixing roller 31 is rotating in the direction of arrow R2 in FIG. 20, the one-way clutch 61 is locked, and the shaft 42*a* of the pressing roller 42 rotates in the direction of arrow R3, as illustrated in FIG. 21A. With the rotation of the shaft 42*a* in the direction of arrow R3 in FIG. 21A, the rollers 61*b* biased by the springs 61*c* move to engagement positions in the recesses formed in the inner circumferential portion of the outer ring 61*a*, and the shaft 42*a* is locked owing to the wedge action between the inner circumferential surfaces of the recesses and the outer circumferential surface of the shaft 42*a*.

With the thus-configured one-way clutch 61, the pressing roller 42 rotatable in the reel-in direction of the web sheet 44 is prevented from rotating in the opposite direction to the reel-in direction. Accordingly, reverse movement of the web sheet 44 is prevented. Further, since the one-way clutch 61 is integrated with the shaft bearing 62, a substantially compact configuration is obtained, which leads to a reduction in space and cost for installation.

As described above, an operation failure (i.e., lock failure) occurring in the one-way clutch 61 may hinder an intended operation. The operation failure may occur particularly when the unlocked one-way clutch 61 is subjected to the pressure from the shaft 42*a* of the pressing roller 42 for an extended period of time or exposed to a low-temperature environment owing to a failure of the wedge action, such as a failure of the rollers 61*b* to move to the lock positions in the wedge-shaped portions. If any pulling force acts on the web sheet 44 when there is slack in the web sheet 44 reeled in around the reel roller 43 and the one-way clutch 61 fails as described above, the slack web sheet 44 is pulled taut out of the reel roller 43 and moved in the reverse direction.

If the cleaning device 60 according to the present embodiment is equipped with the foregoing braking mechanism 45, 48, 50, or 53, however, the web sheet 44 wound around the reel roller 43 has no slack. Accordingly, the reverse movement of the web sheet 44 will not occur even if the one-way clutch 61 fails.

The above description is illustrative, and this disclosure has specific effects for the following aspects.

According to a first aspect of this disclosure, a cleaning device (e.g., the cleaning devices 40 and 60) includes a web sheet (e.g., the web sheet 44) to slide against and clean a surface of a cleaning target object (e.g., the fixing roller 31), a holding member (e.g., the supply roller 41) holding the web sheet wound around the holding member to be reeled out, a reel member (e.g., the reel roller 43) having the web sheet wound around the reel member to be reeled in, a drive device (e.g., the drive device 90) to drive the reel member to rotate, a pressing member (e.g., the pressing roller 42) to press the web sheet against the cleaning target object, and a rotational load-applying device (e.g., the braking mechanisms 45, 48, 50, and 53) to apply a load to rotation of the holding member. The load is changeable depending on an amount of the web sheet held by the holding member.

As described in the foregoing embodiments, according to this configuration, the load is applied to the rotation of the holding member to apply back tension to the web sheet. The load applied by the rotational load-applying device is set to be high in an initial stage of consumption of the web sheet, in which a large amount of the web sheet is held by the holding member, and is reduced with a reduction of the amount of the web sheet held by the holding member. It is thereby possible to reel in the web sheet around the reel member without slack compared with a configuration in which the rotational load-applying device applies a constant load to the rotation of the holding member. Further, since the load applied by the rotational load-applying device is reduced with the consumption of the web sheet, there is no increase in the load on a drive device that drives the reel member, which results in a reduction in cost and space for installing the drive device.

According to a second aspect of this disclosure, in the cleaning device according to the first aspect, the rotational load-applying device (e.g., the braking mechanisms 45, 48, 50, and 53) comes into contact with the web sheet held by the holding member to apply the load to the rotation of the holding member.

As described in the foregoing embodiments, according to this configuration, the rotational load-applying device is capable of controlling the load to change depending on the amount of the web sheet held by the holding member with a simple, low-cost, and space-saving configuration in which the rotational load-applying device is configured to come into contact with the web sheet held by the holding member.

According to a third aspect of this disclosure, in the cleaning device according to the second aspect, the rotational load-applying device (e.g., the first braking members 46 of the braking mechanism 45) comes into contact with end surfaces of the web sheet held by the holding member to apply the load to the rotation of the holding member.

As described in the foregoing embodiments, according to this configuration, the rotational load-applying device is capable of controlling the load to change depending on the amount of the web sheet held by the holding member with a simple, low-cost, and space-saving configuration in which the rotational load-applying device is configured to come into contact with the end surfaces of the web sheet held by the holding member.

According to a fourth aspect of this disclosure, in the cleaning device according to the second aspect, the rotational load-applying device (e.g., the second braking member 49 of the braking mechanism 48, the third braking member 51 of the braking mechanism 50, and the fourth braking members 54*a* to 54*c* of the braking mechanism 53) comes into contact with an outer circumferential surface of the web sheet held by the holding member to apply the load to the rotation of the holding member.

As described in the foregoing embodiments, according to this configuration, the rotational load-applying device is capable of controlling the load to change depending on the amount of the web sheet held by the holding member with a simple, low-cost, and space-saving configuration in which the rotational load-applying device is configured to come into contact with the outer circumferential surface of the web sheet held by the holding member.

According to a fifth aspect of this disclosure, in the cleaning device according to the fourth aspect, the rotational load-applying device (e.g., the braking mechanism 53) is divided into a plurality of portions (e.g., the fourth braking members 54*a* to 54*c*) arranged along a rotational axis of the holding member.

As described in the foregoing embodiments, according to this configuration, the load is controlled to apply a maximum possible load to the rotation of the holding member within the upper limit of a load on the drive device that drives the reel member. Accordingly, the web sheet is reliably reeled in around the reel member without slack.

According to a sixth aspect of this disclosure, in the cleaning device according to the fifth aspect, the plurality of divided portions (e.g., the fourth braking members 54*a* to 54*c*) of the rotational load-applying device (e.g., the braking mechanism 53) apply different loads to the rotation of the holding member.

As described in the foregoing embodiments, according to this configuration, the load is controlled to apply a maximum possible load to the rotation of the holding member within the upper limit of the load on the drive device that drives the reel member. Accordingly, the web sheet is reliably reeled in around the reel member without slack.

According to a seventh aspect of this disclosure, a fixing device (e.g., the fixing device 30) includes a fixing member (e.g., the fixing roller 31) having an endless movable surface and housing a heating device, a pressure member (e.g., the pressure roller 32) having an endless movable surface that comes into contact with the fixing member to form a fixing nip between the pressing member and the fixing member, and the cleaning device (e.g., the cleaning devices 40 and 60) according to one of the first to sixth aspects to clean the surface of at least one of the fixing member and the pressing member. A recording medium carrying a toner image is fed through the fixing nip to fix the toner image on the recording medium with heat and pressure.

As described in the foregoing embodiments, this configuration prevents reverse movement of the web sheet in the cleaning device, and thus prevents a cleaning failure due to the reverse movement of the web sheet, image contamination due to toner having failed to be captured by the web sheet, and sheet jam due to the reversed web sheet.

According to an eighth aspect of this disclosure, an image forming apparatus (e.g., the printer 1000) includes an image carrier (e.g., the photoconductor drums 10Y, 10C, 10M, and 10K), a toner image forming device (e.g., the image forming device 80) to form a toner image on the image carrier, a transfer device (e.g., the intermediate transfer unit 7) to transfer the toner image from the image carrier onto a recording medium (e.g., the transfer sheet 19), and the fixing device (e.g., the fixing device 30) according to the seventh aspect to fix the transferred toner image on the recording medium.

As described in the foregoing embodiments, this configuration prevents reverse movement of the web sheet in the cleaning device, and thus prevents a cleaning failure due to the reverse movement of the web sheet, image contamination due to toner having failed to be captured by the web sheet, and sheet jam due to the reversed web sheet.

A cleaning device according to an embodiment of this disclosure, a fixing device including the cleaning device, and an image forming apparatus including the fixing device are capable of preventing, with a low-cost, space-saving configuration, a web sheet reeled in around a reel member from being moved in a direction opposite to a reel-in direction owing to slack of the web sheet.

The above-described embodiments are illustrative and do not limit this disclosure. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of this disclosure may be practiced otherwise than as specifically described herein.

What is claimed is:

1. A cleaning device comprising:

a web sheet to slide against and clean a surface of a cleaning target object;

a holding member holding the web sheet wound around the holding member to be reeled out;

a reel member having the web sheet wound around the reel member to be reeled in;

a drive device to drive the reel member to rotate;

a pressing member to press the web sheet against the cleaning target object; and a rotational load-applying device to apply a load to rotation of the holding member, the load being changeable depending on an amount of the web sheet held by the holding member, wherein the rotational load-applying device includes a contact surface formed in a tapered shape in cross-section.

2. The cleaning device according to claim 1, wherein the rotational load-applying device comes into contact with the web sheet held by the holding member to apply the load to the rotation of the holding member.

3. The cleaning device according to claim 2, wherein the rotational load-applying device comes into contact with end surfaces of the web sheet held by the holding member to apply the load to the rotation of the holding member.

4. The cleaning device according to claim 2, wherein the rotational load-applying device comes into contact with an outer circumferential surface of the web sheet held by the holding member to apply the load to the rotation of the holding member.

5. The cleaning device according to claim 4, wherein the rotational load-applying device is divided into a plurality of portions arranged along a rotational axis of the holding member.

6. The cleaning device according to claim 5, wherein the plurality of divided portions of the rotational load-applying device apply different loads to the rotation of the holding member.

7. A fixing device comprising:

a fixing member having an endless movable surface and housing a heating device;

a pressure member having an endless movable surface that comes into contact with the fixing member to form a fixing nip between the pressure member and the fixing member; and the cleaning device according to claim 1 to clean the surface of at least one of the fixing member and the pressure member, wherein a recording medium carrying a toner image is fed through the fixing nip to fix the toner image on the recording medium with heat and pressure.

8. An image forming apparatus comprising:

an image carrier;

a toner image forming device to form a toner image on the image carrier;

a transfer device to transfer the toner image from the image carrier onto a recording medium; and the fixing device according to claim 7 to fix the transferred toner image on the recording medium.

9. The cleaning device according to claim 1, wherein the tapered shaped of the contact surface of the rotational load-applying device moves away from an end surface of the web sheet toward a center of rotation.

10. The cleaning device according to claim 1, wherein the rotational load-applying device is co-axially disposed to a shaft of the holding member.

11. The cleaning device according to claim 10, wherein the rotational load-applying device is co-axially disposed to each of an opposed end portions of a shaft of the holding member.

12. The cleaning device according to claim 1, further comprising a plurality of springs in a circumferential direction of the rotational load-applying device.

13. The cleaning device according to claim 12, wherein each of the springs has one end fixed to a side plate of a fixing device and the other end attached to the rotational load-applying device.

14. The cleaning device according to claim 12, wherein the rotational load-applying device is biased against the web sheet wound around the holding member by an elastic force of the plurality of springs.

* * * * *